US006778169B1

(12) United States Patent
Hiraga et al.

(10) Patent No.: US 6,778,169 B1
(45) Date of Patent: Aug. 17, 2004

(54) CONTROLLER DRIVER FOR DISPLAY DEVICE AND DRIVING METHOD THEREOF

(75) Inventors: Minoru Hiraga, Chiba (JP); Hiroshi Yamaguchi, Chiba (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 0 days.

(21) Appl. No.: 09/436,295

(22) Filed: Nov. 8, 1999

(30) Foreign Application Priority Data

Nov. 11, 1998 (JP) ..... 10-320714

(51) Int. Cl.[7] ..... G09G 5/00
(52) U.S. Cl. ..... 345/213; 345/75.1
(58) Field of Search ..... 345/75.1, 188, 345/515, 193, 196, 513, 197, 516, 517, 213, 204; 315/169.2, 169.4; 349/69

(56) References Cited

U.S. PATENT DOCUMENTS 4,204,209 A * 5/1980 Suehiro ..... 340/758
5,021,775 A * 6/1991 Babin ..... 340/814
5,202,668 A * 4/1993 Nagami ..... 340/705
5,475,402 A * 12/1995 Hijikata ..... 345/211
5,808,590 A * 9/1998 Kawasaki et al. ..... 345/47
6,025,821 A * 2/2000 Mart ..... 345/75

* cited by examiner

*Primary Examiner*—Vijay Shankar
*Assistant Examiner*—Nitin Patel
(74) *Attorney, Agent, or Firm*—Katten Muchin Zavis Rosenman

(57) ABSTRACT

A controller driver for a fluorescent display unit for use in a display system is connected to a host micom which controls operations of the display system and to a display unit. The controller driver comprises an interface, a decoder, a display RAM, an electrode driver, a controller and a clock generator. The interface transfers data from/to the host micom. The decoder identifies and divides the data received from the interface into command data and display data. The display data includes anode data and grid data and the electrode driver includes therein an anode driver and a grid driver. The display RAM stores the display data received from the decoder. The electrode driver actuates the display unit by using the command data and the display data. The controller sets a driving mode and a display mode by using the command data, retrieves the display data and provides the display data to the electrode driver. The clock generator provides timing signals for the interface, the decoder, the anode driver, the grid driver, the display RAM and the controller to coordinate operation timings thereof. The anode data and the grid data are provided to the anode driver and the grid driver, respectively, according to a predetermined timing address.

17 Claims, 13 Drawing Sheets

FIG. 6

A. SETTING OF DISPLY STATE

| 0 | 0 | 0 | 0 | $A_3$ | $A_2$ | $A_1$ | $A_0$ |
|---|---|---|---|---|---|---|---|

| | | | | | |
|---|---|---|---|---|---|
| 1 | 1 | 1 | 1 | → 15 / 16 | ON |
| 1 | 1 | 1 | 0 | → 14 / 16 | ON |
| ⋮ | ⋮ | ⋮ | ⋮ | ⋮ | ON |
| 0 | 0 | 0 | 0 | → 0 / 16 | OFF |

B. SETTING OF PULSE WIDTH

| 0 | 0 | 0 | 1 | $B_3$ | $B_2$ | $B_1$ | $B_0$ |
|---|---|---|---|---|---|---|---|

1 1 1 1 → K=16

⇓

0 0 0 0 → K=1

C. DATA TRANFER FROM DISPLAY RAM TO DRIVER

| 0 | 0 | 1 | 0 | – | – | – | $C_0$ |
|---|---|---|---|---|---|---|---|

1 → ON (AUTO–SCANNING)

0 → OFF (STATIC DRIVING)

$C_1$. $C_0$=START ADDRESS WHEN $C_0$=1

| – | – | X | X | X | X | X | X |
|---|---|---|---|---|---|---|---|

↓

$C_2$. $C_0$=END ADDRESS WHEN $C_0$=1

| – | – | X | X | X | X | X | X |
|---|---|---|---|---|---|---|---|

↓

CS $C_3$. DIMMING DATA WHEN $C_0$=0

| – | – | X | X | X | X | X | X |
|---|---|---|---|---|---|---|---|

↓

CS'

D. DATA TRANSFER OF DISPLY RAM

| 0 | 0 | 1 | 1 | – | – | $D_1$ | $D_0$ |
|---|---|---|---|---|---|---|---|

1 1 → ADDRESS 1 BIT INCREASE
1 0 → ADDRESS 64 BITS INCREASE
0 1 → DATA 1 BYTE ADDRESS ASSIGNMENT
0 0 → NULL OR DEFAULT

E. ① DATA TRANSFER (INCREMENT OPERATION)

② DATA TRANSFER (ADDRESS DESIGNATION)

FIG. 8

F. TURNING ON VFD

| | | | | | | | |
|---|---|---|---|---|---|---|---|
| 0 | 1 | 0 | 0 | – | – | – | – |

G. SELF–DIAGNOSIS

| | | | | | | | |
|---|---|---|---|---|---|---|---|
| 0 | 1 | 0 | 1 | X | X | X | X |

H. AUTOMATIC GRID OFF

| | | | | | | | |
|---|---|---|---|---|---|---|---|
| 0 | 1 | 1 | 0 | – | – | – | $G_0$ |

1 → ON
0 → OFF

WHEN $G_0 = 1$

| | | | | | | | |
|---|---|---|---|---|---|---|---|
| – | X | X | X | X | X | X | X |

↓

| | | | | | | | |
|---|---|---|---|---|---|---|---|
| – | X | X | X | X | X | X | X |

↓

CS

FIG. 11

ANODE CONNECTION

| | 1G ~11G | 12G ~26G | 27G ~48G |
|---|---|---|---|
| P1 | 1-2 | 1-2 | 1-2 |
| P2 | 1-1 | 1-1 | 1-1 |
| P 3 | 1-3 | 1-3 | 1-3 |
| P 4 | 1-4 | 1-4 | 1-4 |
| P 5 | 2-2 | 2-2 | 2-2 |
| P 6 | 2-1 | 2-1 | 2-1 |
| P 7 | 2-3 | 2-3 | 2-3 |
| P 8 | 2-4 | 2-4 | 2-4 |
| P 9 | 3-2 | 3-2 | 3-2 |
| P10 | 3-1 | 3-1 | 3-1 |
| P11 | 3-3 | 3-3 | 3-3 |
| P12 | 3-4 | 3-4 | 3-4 |
| P13 | 4-2 | 4-2 | 4-2 |
| P14 | 4-1 | 4-1 | 4-1 |
| P15 | 4-3 | 4-3 | 4-3 |
| P16 | 4-4 | 4-4 | 4-4 |
| P17 | 5-2 | 5-2 | 5-2 |
| P18 | 5-1 | 5-1 | 5-1 |
| P19 | 5-3 | 5-3 | 5-3 |
| P20 | 5-4 | 5-4 | 5-4 |

| | 1G ~11G | 12G ~26G | 27G ~48G |
|---|---|---|---|
| P21 | 6-2 | 6-2 | 6-2 |
| P22 | 6-1 | 6-1 | 6-1 |
| P23 | 6-3 | 6-3 | 6-3 |
| P24 | 6-4 | 6-4 | 6-4 |
| P25 | 7-2 | 7-2 | 7-2 |
| P26 | 7-1 | 7-1 | 7-1 |
| P27 | 7-3 | 7-3 | 7-3 |
| P28 | 7-4 | 7-4 | 7-4 |
| P29 | - | B1 | メモリー |
| P30 | - | B2 | 反転 |
| P31 | - | B3 | B4 |
| P32 | | B4 | A4 |
| P33 | | B5 | 倍 |
| P34 | - | B6 | 0.8 |
| P35 | - | B7 | 1.0 |
| P36 | - | B8 | 1.2 |
| P37 | 通信中 | B9 | 1.4 |
| P38 | 写 | B10 | S1 |
| P39 | ノンコール | 録音残量 | ハンドコピー |
| P40 | | | S2 |

CONTROLLER DRIVER FOR DISPLAY DEVICE AND DRIVING METHOD THEREOF

FIELD OF THE INVENTION

The present invention relates to a display device; and, more particularly, to a driver and a driving method therefor capable of displaying various desired patterns by dynamically driving display elements including matrix-shaped dots and multiple display segments.

DESCRIPTION OF THE PRIOR ART

A display device having fluorescent electrodes as its display elements displays a variety of information in a form of characters or graphics or a combination thereof by appropriately controlling the fluorescent electrodes and driving, e.g., grid electrodes in accordance with the characters or graphics or the combination thereof to be displayed thereon.

A matrix pattern incorporated in the display device is constructed with anodes used as the fluorescent electrodes and with grids used in controlling electrons arriving at the anodes, the anodes and the grids being activated by a dynamic driving method, wherein pulse signals are in a time-shared manner, thereby enabling the display device to display rather complicated graphics and characters or the combination thereof with a reduced number of wires.

In addition to the above, it is also possible to dynamically display a large quantity of time varying information on a screen by scrolling the graphics or the characters or the combination thereof in an appropriate direction especially when the anodes are dot-shaped.

FIG. 12 represents a block diagram of a conventional display device for use in, e.g., a variety of electronics equipments and machines, for displaying various information such as operating information, time information, etc. The display device includes drivers capable of visualizing various information provided by display data from a host micom (micro-computer) storing therein control program of the equipments.

In FIG. 12, a reference numeral 10 represents a VFD (vacuum fluorescent display), composed of, e.g., vacuum fluorescent tubes. Generally, electrodes in the VFD are structured such that various graphics or characters or the combinations thereof are displayed using segmented electrodes and dot-shaped fluorescent elements.

An anode driver 20*a* and a grid driver 20*b* serve as the driving circuits for activating anodes and grids of the VFD 10, respectively. These drivers 20*a* and 20*b* generally include therein switching elements being switched on and off by control pulses, shift registers and latches.

A reference numeral 30 denotes a general controller (referred to hereinafter as "host micom") comprised of, e.g., a host micro-computer. The host micom 30, which stores a program corresponding to the electrode structure of the VFD 10, controls the display device. For instance, the host micom 30 provides the anodes and grids of the VFD 10 with display data based on a status of a peripheral device 40. Specifically, the host micom 30 reads from a memory (not shown) therein data corresponding to characters or graphics or a combination thereof to be displayed by the VFD 10 and timely outputs the data (i.e., the display data) to the drivers 20*a* and 20*b*.

Conventionally, the VFD 10, the anode driver 20*a* and the grid driver 20*b* are mounted on a single circuit board. It is also designed so that in addition to allowing the host micom 30 controlling the peripheral device 40, e.g., a servo motor, according to the display contents, it also allows a machine to be controlled in response to a command signal from a control panel 50.

The conventional display device described above, however, although dependent in part on the capability of the host micom 30, has difficulties in changing or modifying display contents because it has been rather difficult to change or modify the programs stored in the host micom 30, and, therefore, has found its applications to one that requires a rather small number of display contents and/or rather simple display systems. In other words, there exist limitation in the use of the conventional display system described above for various display modes thereof.

In an attempt to overcome these limitations, a modified conventional display device has been adopted as shown in FIG. 13. The modified display device of FIG. 13 is characterized in that it is additionally equipped with a sub-micom 60 between the host micom 30 and each of the anode driver 20*a* and the grid driver 20*b* compared with the display device of FIG. 12 to thereby enable it to display rather complicated display patterns and enjoy a certain degree of universality. The sub-micom 60 is additionally incorporated therein to take over functions relating to the control operations relative to the VFD 10 while the host micom 30 performs rather simple control operations and performs functions such as providing the display data for the drivers 20*a* and 20*b*. The control operations in relation to the VFD 10 include: performing control relative to a display mode from the sub-micom 60; transferring the display data associated with the display mode; maintaining the display data; and performing a signal processing and the like. With the help of this additional sub-micom 60, the host micom 30 is allowed to reduce its load significantly, thereby enabling the modified display device to display more complicated and diverse display contents.

There are, however, still certain disadvantages in the modified display device, e.g., it imposes a requirement that the sub-micom 60 and the drivers 20*a* and 20*b* closely interwork with each other. If a variety of electrode structures and/or driving methods are engaged in the modified display device, a plurality of sub-micoms corresponding to each structure and method must be employed, which exacts time and costs in designing and adapting each of the sub-micoms thereto. This may simply degenerate the desired variety and universality.

Meanwhile, an alternative controller driver may be proposed wherein a multiple number of distinct sub-micoms and the two drivers 20*a* and 20*b* are merged into an integrated circuit and the integrated circuit in turn, being connected to a couple of VFDs which are designed to accommodate a large volume of display contents corresponding to the multiple number of sub-micoms. Even in this alternative controller driver, the display capability thereof is limited to the number of combinations of the driving methods of the controller driver.

Further, it does not allow additional display modes or scan modes to be added thereto.

SUMMARY OF THE INVENTION

It is, therefore, a primary object of the present invention to solve the above described problems.

In accordance with one aspect of the present invention, there is provided a controller driver, connected to a host micom for controlling operations of a display system and to a display unit, for actuating a display unit, the controller driver comprising: an interface for transferring data from/to the host micom; a decoder for identifying and dividing the data received from the interface into command data and display data; a display RAM for storing the display data received from the decoder, wherein the display data includes anode data and grid data, the anode data being associated with display contents and the grid data being associated with a driving mode of the display unit; an electrode driver, including therein an anode driver and a grid driver, for actuating the display unit by using the command data and the display data; a controller for setting the driving mode and a display mode by using the command data, and, for retrieving the display data and providing the display data to the electrode driver; and a clock generator for providing timing signals for the interface, the decoder, the anode driver, the grid driver, the display RAM and the controller to coordinate operation timings thereof, wherein the anode data and the grid data are provided to the anode driver and the grid driver, respectively, according to a predetermined timing address.

In accordance with another aspect of the present invention, there is provided a method for driving a display device equipped with a plurality of controller drivers and a display unit, each of the controller drivers including: an interface for transferring data from/to a host computer; a decoder for decoding the data received from the interface into command data and display data; a display RAM for storing the display data received from the decoder; an anode and a grid drivers for driving a display unit based on the display data of the display RAM; a controller for setting a display mode based on the command data and for retrieving the display data corresponding to a display mode; and a clock generator for providing timing signals for the interface, the decoder, the display RAM and the controller to coordinate operation timing thereof, wherein the method comprising: connecting the plurality of controller drivers to the display unit, distributing data corresponding to display areas of the display unit and controlling operations of the plurality of controller drivers in synchronism with each other as of turning on/off the display unit.

It is possible, in accordance with the present invention, to diversify display contents by providing a display RAM storing command data and display data such that a plurality of controller drivers described above are connected to a single VFD and are controlled to operate in synchronism with each other.

The controller driver in accordance with the present invention is capable of implementing a universal driving mode of the VFD (single grid driving, dual grid driving, multi-matrix driving, etc.) and various complicated display functions without burdening the host micom. These can be achieved by synchronizing the period of a clock source for use in setting timing with an external sync signal, and, at the same time, employing a plurality of controller drivers whose number depends on the size of the VFD.

BRIEF DESCRIPTION OF THE DRAWINGS

The above and other objects and features of the present invention will become apparent from the following description of preferred embodiments given with reference to the accompanying drawings, in which:

FIGS. 6*a* to 8*h* represent exemplary formats of command data in accordance with the present invention;

FIG. 11 explains in detail exemplary connections of anode electrodes in accordance with the present invention;

DETAILED DESCRIPTION OF THE PREFERRED EMBODIMENTS

Figure 1:
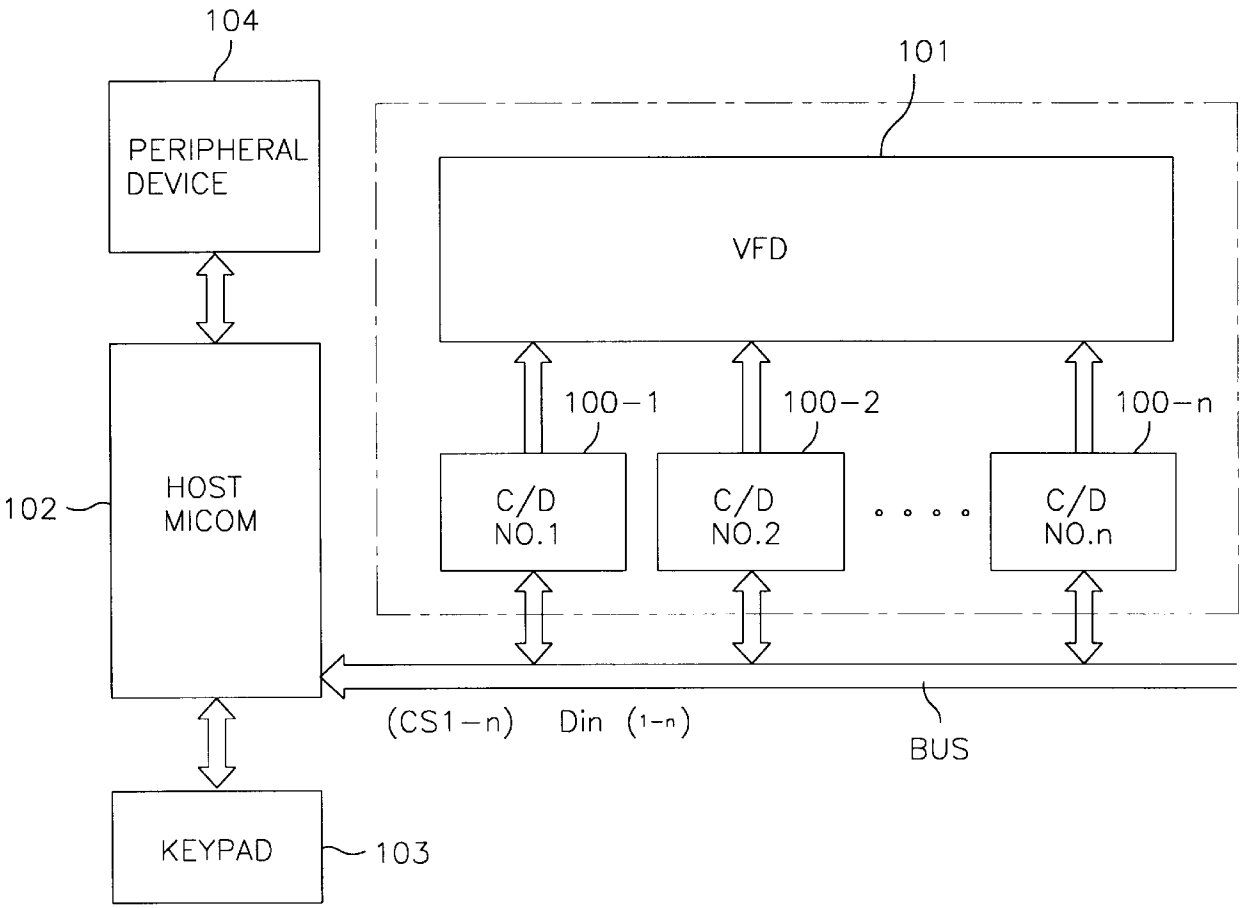
FIG. 1 presents a block diagram of a fluorescent display device in accordance with the present invention.

Referring to FIG. 1, there is illustrated a block diagram of a display device with a driver actuating, e.g., fluorescent display elements in accordance with the present invention.

In the display device, a reference numeral 100 represents a unit of a semiconductor chip board 100 (hereinafter referred to as "controller driver(s)"). A plurality of controller drivers 100-1 to 100-n, the number thereof depending on display modes and display contents of a VFD 101, operate in a predefined timing schedule, i.e., in synchronism with each other.

Each controller driver includes therein an interface (not shown) for use in receiving command data and display data from a host micom 102. Each interface is connected in parallel to the host micom 102 via a shared bus.

The host micom 102 may be an ordinary personal computer having such functions as displaying in connection with a peripheral device 104, printing and maintaining data, etc. In case the host micom 102 controls certain types of electronic devices, there may be attached to the host micom 102 a servo motor or a clocking device thereto as its peripheral device allowing it to perform functions such as assigning a display format and generating data to be displayed in response to inputs from a keypad 103.

The number of controller drivers 100-1~n employed may be varied depending on driving modes, display contents and an electrode structure of the VFD 101. The controller drivers 100-1~n drive the single VFD 101 in a predetermined timing schedule under the control of the host micom 102.

Figure 2A:
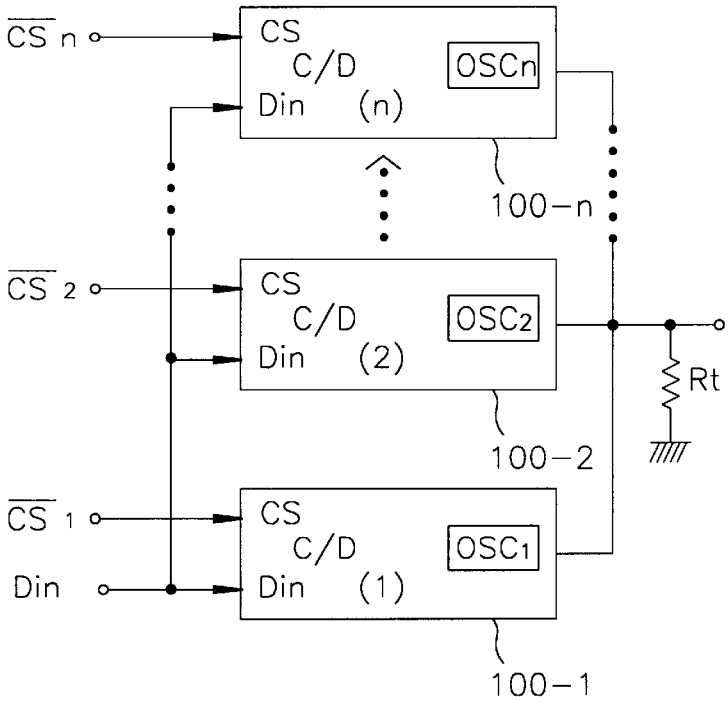
FIGS. 2*a* and 2*b* describe connection methods within the controller driver in accordance with the present invention.
Figure 2B:
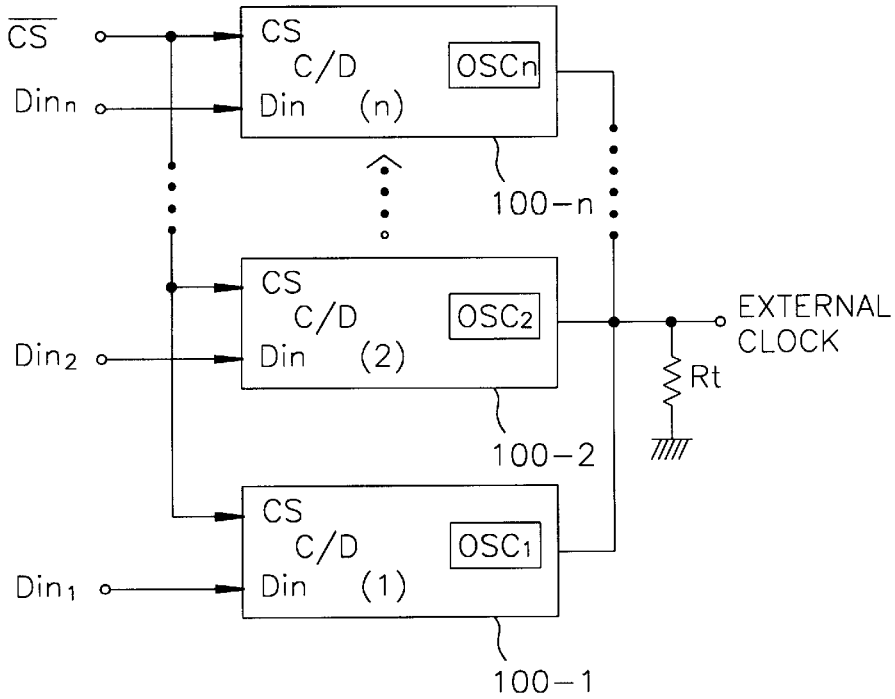

FIG. 2*a* and 2*b* describe data timing and connection methods when the host micom 102 provides command data for each of the controller drivers 100-1~n via the shared bus, wherein the command data is used for assigning the display contents to the VFD 101.

FIG. 2*a*, in particular, describes a data distribution type for providing data $D_{in}$ to each of the controller drivers 100-1~n in a time-sharing manner. FIG. 2*b* describes a driver distribution type for providing data $D_{in}$ in for each of the controller drivers 100-1~n by using separate transmission lines $D_{in-1}$ to $D_{in-n}$.

In the data distribution type shown in FIG. 2*a*, the data to each of the controller drivers 100-1~n are serially transmitted through a common data bus. Each of the controller drivers 100-1~n receives the data destined thereto at a falling edge of a chip select (CS) signal and stops receiving data at a rising edge of the chip select signal.

In the driver distribution type shown in FIG. 2*b*, separate data buses are connected to each controller driver, respectively. In this type, the chip signal is utilized by each controller driver during the receiving of the display data thereto via the host micom 102 and the corresponding data bus, the chip signal being transmitted thereto when the display data is first transmitted to the host micom 102.

Therefore, while the data distribution type has the advantage of exacting less buses than the driver distribution type, it requires more time in initial setting and a display setting of the VFD 101. On the other hand, while the driver distribution type enjoys shorter data transmission time, it demands rather large capacity buses.

There are two kinds of data provided to each controller driver; namely, command data and display data. The command data relates to the driving mode, the brightness setting and the identity of the data type, etc. The display data relates to a display segments of the VFD 101. These data are transferred with a predetermined sequence and format, e.g., by a unit of one byte.

Each of the local clocks $OSC_{1\sim n}$ is appended to each controller driver and it is also commonly connected to a resistor $R_t$. The local clocks are used for controlling the controller drivers 100-1~n to operate in synchronism with each other, respectively.

In addition, an external clock(s) (not shown) connected to the resistor $R_t$ may be employed with a view to controlling the controller drivers 100-1~n to operate in a synchronous manner.

Figure 3:
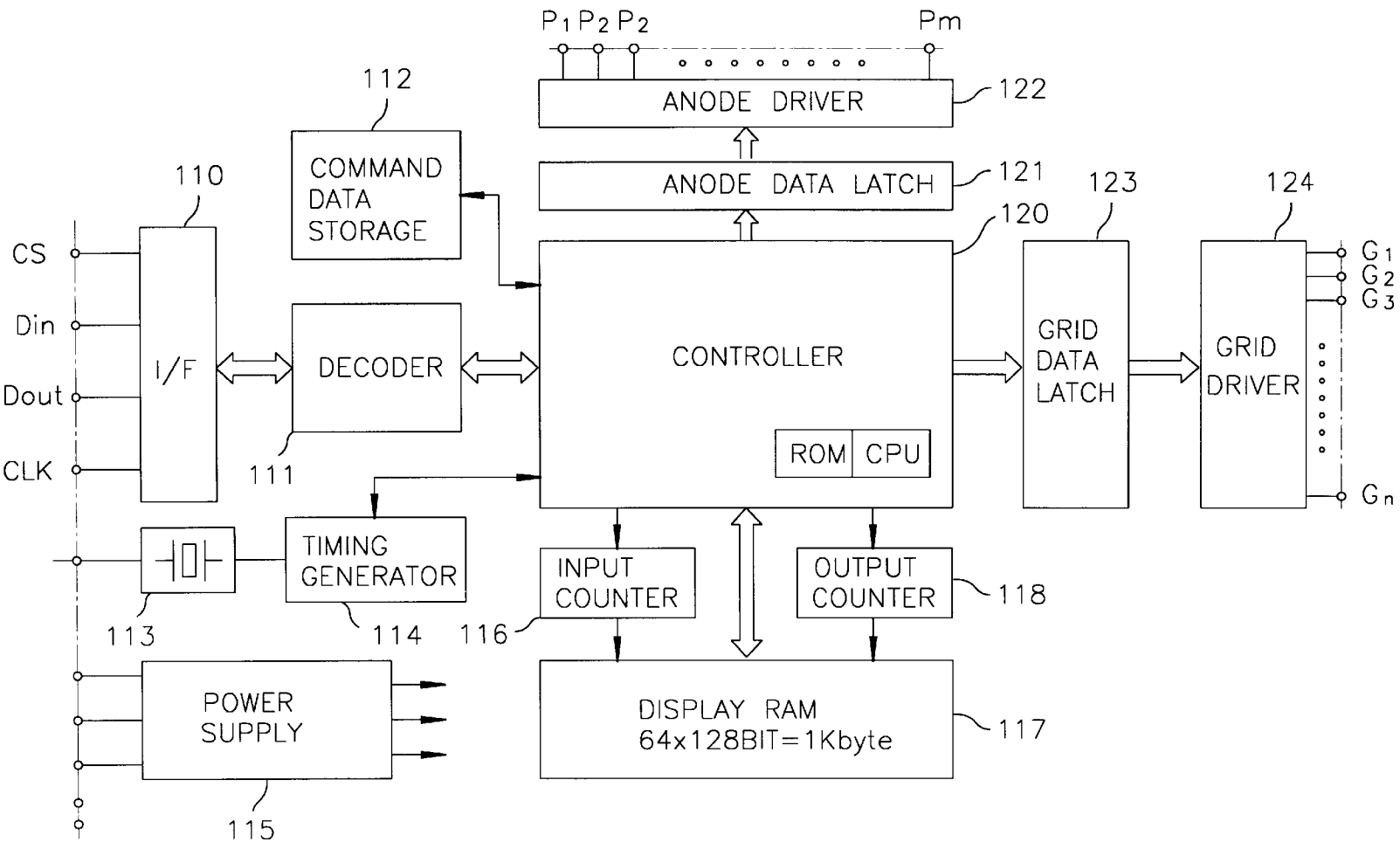
FIG. 3 depicts functional sub-blocks employed in a controller driver in accordance with the present invention.

Functions of sub-blocks in each controller driver will now be described in detail using FIG. 3.

The data exchange between each controller driver and the host micom 102 is coordinated by an interface 110. A decoder decodes the data received from the interface 110 by a unit of one byte, e.g., identifying and dividing the data into the command data and the display data. The command data from the decoder 111 is then stored in a command data storage 112 to be accessed by a controller 120.

Each local clock 113 produces a clock signal whose timing is synchronously adjusted with respect to other controller drivers. The output from each local clock 113 is stored in a controller 120 or provided to a timing generator 114 to form a timing signal of each controller driver. The timing signal generated by the timing generator 114 is provided to each sub-block and is used as a reference clock in retrieving the display data to be fed to the VFD 101 from the controller 120 and in determining a timing of a scan pulse signal to be later generated by the controller 120.

A power supply 115 provides operating voltages to each sub-block and to the VFD 101.

The controller 120 includes therein a ROM and a CPU. By using these ROM and the CPU, the controller 120 generates the scan pulse signal from the grid data according to the command data, activates an input counter 116 which designates addresses of the display data to be stored in a display RAM 117, reads out the display data stored in the display RAM 117 by using addresses designated by an output counter 118 and transmits the display data read out from the display RAM 117 to drivers 122 and 124.

An anode data latch 121 incorporates therein a shift register for use in shifting the data to be finally fed to the anodes $P_1$ to $P_m$ of the VFD 101 in a line direction, e.g., according to a timing address of the display RAM 117. The anode data in the anode data latch 121 is transferred to an anode driver 122 which is mainly composed of switching circuits and finally to the anodes $P_1$ to $P_m$ in synchronism with a strobe pulse signal.

The controller 120 retrieves the grid data for use in scanning grids from the display RAM 117 and transfers this data to a grid driver 124 via a grid data latch 123 to actuate the grids $G_1$ to $G_n$ of the VFD 101.

As described above, the controller drivers 100-1~n in accordance with the present invention have the distinct feature of storing the grid data for use in scanning the grids and the anode data for actuating the anodes in the display RAM 117. If the controller drivers 100-1~n are set to be operated in a static driving mode, certain anodes are selected according to the anode data, and, if the controller drivers 100-1~n are set to be operated in a single grid scan mode, grids arranged serially in the horizontal direction are driven to be sequentially turned on.

In addition, when the grids $G_1$ to $G_n$ of the VFD 101 are designed as a dual wire grid type, voltages can be applied such that two adjacent grids are concurrently selected and turned on in the horizontal direction according to grid data from the display RAM 117.

Furthermore, if, e.g., a multi-anode matrix type is employed in the VFD 101, the grid scan may be performed according to the number of divided anodes. Additionally, a universal driving mode conforming to the display contents can be realized by combining, e.g., the above described driving modes.

Figure 4:
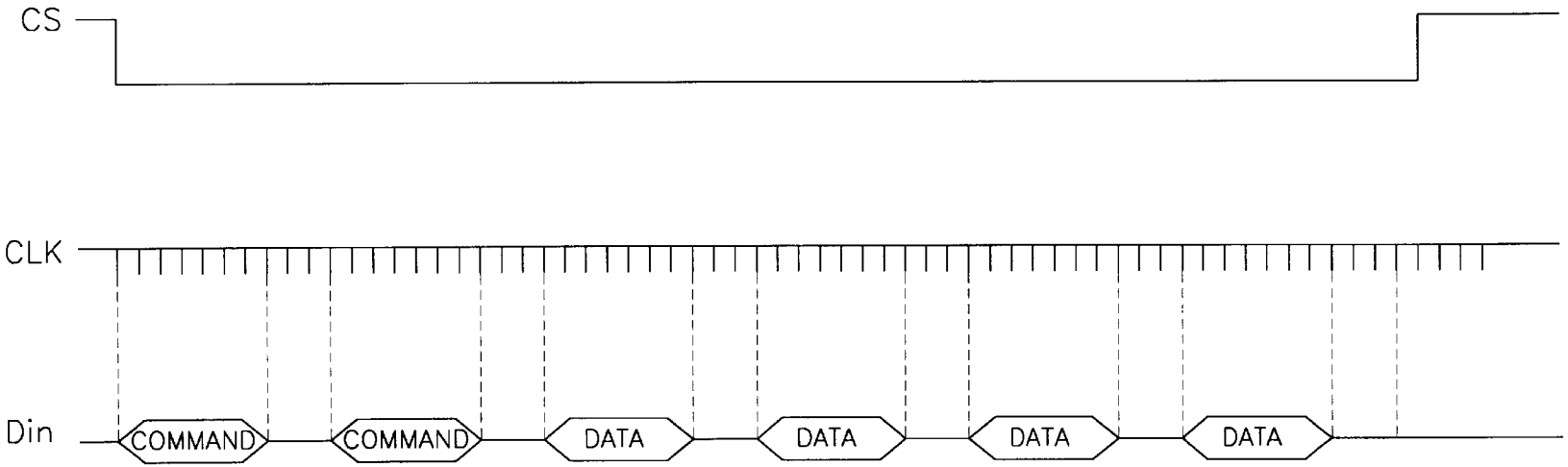
FIG. 4 displays a timing diagram observed while the controller driver receives data from a host micom in accordance with the present invention.

Referring to FIG. 4, there is shown an exemplary timing observed while each of the controller drivers 100-1~n receives the data from the host micom 102.

As seen from FIG. 4, each controller driver starts receiving the data upon the falling edge of the chip select signal and stops receiving the data upon a rising edge of the chip select signal, completing one data receiving cycle.

The first one or two data after the falling edge of the chip select signal is regarded as the command data and the data following the command data is regarded as the display data.

As an alternative, a busy signal may be used to request the data from the host micom 102 or stops data transmission.

The data read in at the falling edge of the clock signal and read out at a rising edge of the clock signal are both in a unit of eight bits. If desired, several clocks may lapse between the reading of each byte. The command data are kept at the command data storage 112 and the display data are stored at the addresses in the display RAM 117 designated by the controller 120.

Figure 5:
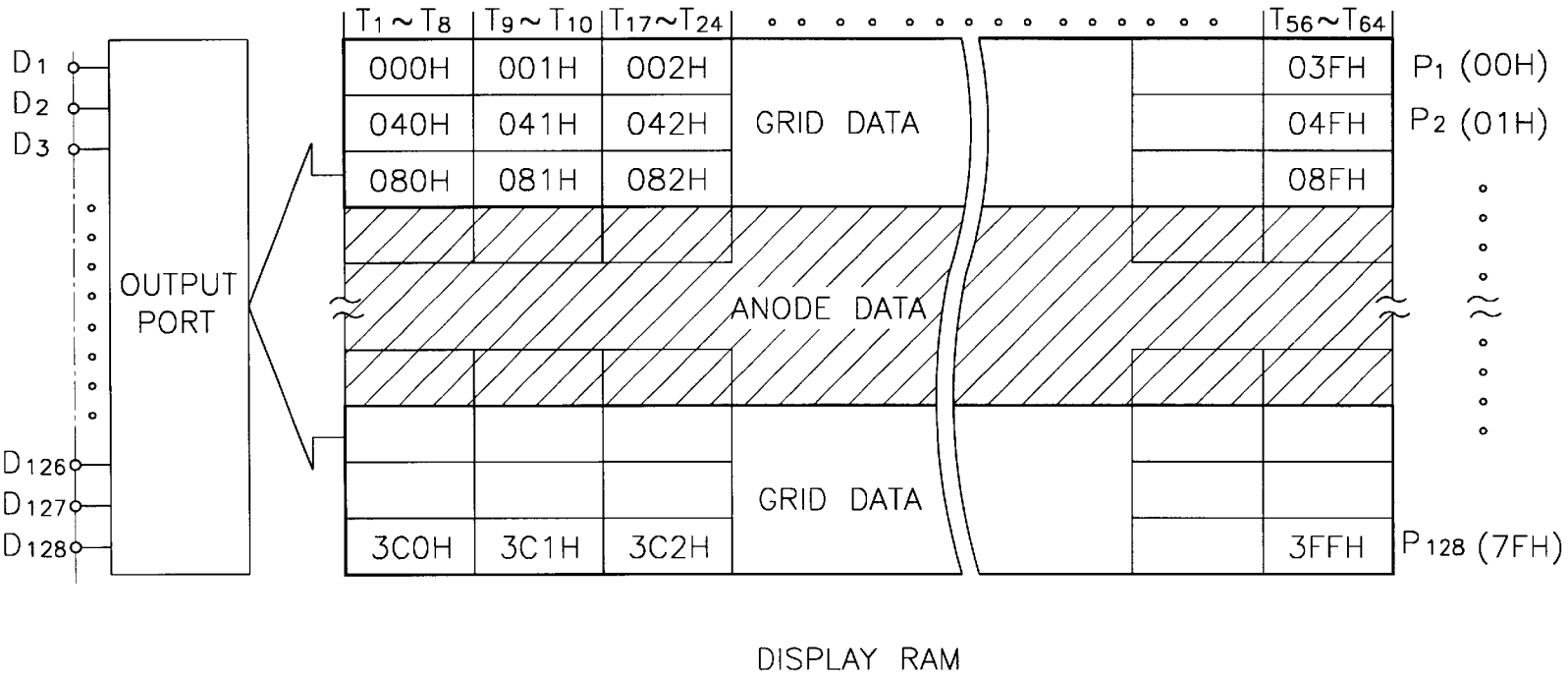
FIG. 5 illustrates a memory map of a display RAM in accordance with the present invention.

Referring to FIG. 5, there is illustrated a memory map of the display RAM 117. Each row in the display RAM 117 presents 64 timing addresses and each column presents 128 port addresses. At a middle portion of each column, hatched in FIG. 5, there are stored the anode data and in the remaining portion of the display RAM 117, there are stored the grid data. The assignment of the storage area of the anode data and the grid data corresponds to the arrangement of the electrodes in the VFD 101.

The storage locations of the anode and the grid data in the display RAM 117 may be determined by using the command data which precedes the display data, the display data including the anode and the grid data, while the display RAM 117 receives the data from the host micom 102. For instance, the display data received may be assigned to be sequentially stored in an increasing order of addresses, or, optionally, each display data may be stored in a timing address individually designated by the command data.

On the other hand, in case the display data are read out from the display RAM 117, and herein assuming the display memory 117 is accessed by using the timing addresses, the display data in the leftmost column, i.e., in the 128 port addresses of "000H" to "3C0H" are concurrently read out in parallel to reach an output port, wherein "H" included in the addresses stands for a hexadecimal number. Subsequently, the next column is read out and so on as the timing address is increased. Among the display data read out from the display RAM 117, the anode data is sent to the anode driver 122 and the grid data is sent to the grid driver 124.

If the driving type is set to be a scan mode, the display data is read out by designating a start address and an end address, and a certain portion of the VFD 101 is controlled to be displayed in a scroll manner while the other part, the area composed of the segments, is controlled in a static driving mode.

Turning now to the command data, exemplary formats of the command data will be described.

FIG. 6*a* shows the format of the command data associated with setting a display state, e.g., a dimming control. Hereinafter, "X" represents data and "-" represents null data. The dimming control is performed by using the lower four bits $A_0$ to $A_3$ with the upper four bits being set to "0000".

If the lower four bits $A_0$ to $A_3$ are set to be "1111", the display of the VFD 101 is turned on with a dimming level of 15/16 and if $A_0$ to $A_3$ are set to be "1110", the display is turned on with a dimming level of 14/16 and so on. The smaller the binary number of $A_0$ to $A_3$, the lower the dimming level is. If $A_0$ to $A_3$ are set to be "0000", the display is set to be turned off.

FIG. 6*b* shows a format of the command data when the VFD 101 is operated in a dynamic driving mode. This format determines the pulse widths. In this event, the upper four bits of the command data are set to be "0001". In addition, if the lower four bits $B_0$ to $B_3$ are set to be "1111", K is 16 and if four lower bits $B_0$ to $B_3$ are set to be "1110", K is 15 and so on. If the lower four bits $B_0$ to $B_3$ are set to be "0000", K is 1.

If a pulse width of the scan pulse signal when the VFD 101 is operated in the dynamic driving mode, is TP, and a blanking time is TB, TP and TB are determined as $TP=J\times K\times n\times D_{im}$ and $TB=(1-D_{im})\times TP$, wherein J represents a clock period, e.g., 1 to 2 microseconds of the local clock 113, K is an integer and $D_{im}$ denotes the dimming level.

FIG. 6*c* shows a format of the command data for use in setting data transmitted from the display RAM 117 to each controller driver. In this event, the upper four bits of the command data are set to be "0010".

When the least significant bit $C_0$ is set at "1", an auto-scanning mode is on. If an auto-scanning is performed with regard to timing addresses "000H" to "03FH" ($T_1$ to $T_{64}$) of the memory map as illustrated in FIG. 5, the data is transmitted from one in a start timing address of "00H" as shown in FIG. 6*c*1 and to one in an end timing address of "3FH" as shown in FIG. 6*c*2, which completes the scanning of the whole data in the display RAM 117.

When the least significant bit is set at "0", the static driving mode is performed. In this event, one byte of the addresses included in the timing addresses "000H" to "3FH" ($T_1$ to $T_{64}$) is transmitted, thereby completing the static driving mode. This one byte becomes a memory reading timing while the static driving mode is performed.

Even in this static driving mode, the dimming control of a certain segment can be achieved by sequentially changing the start timing address.

Figure 7:
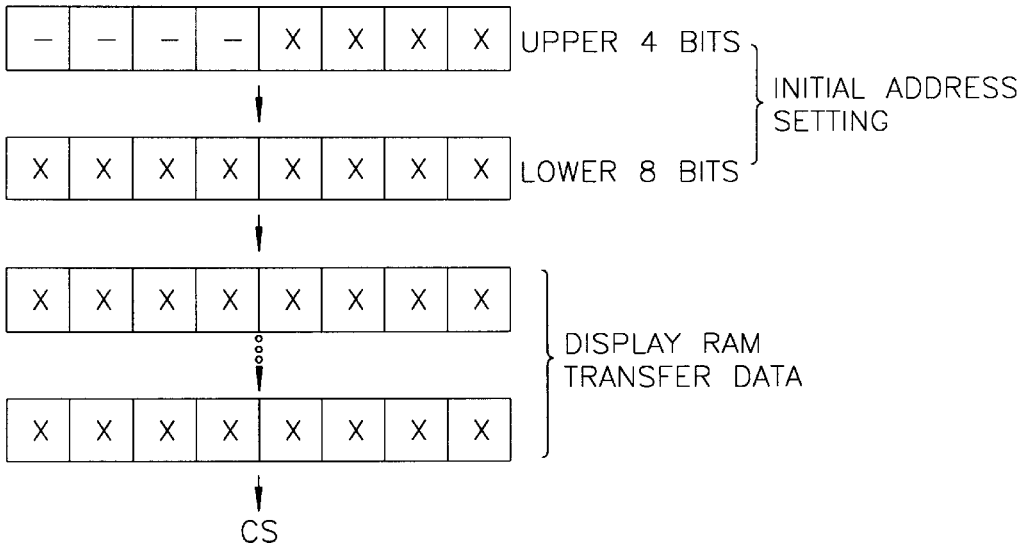
Figure 7:
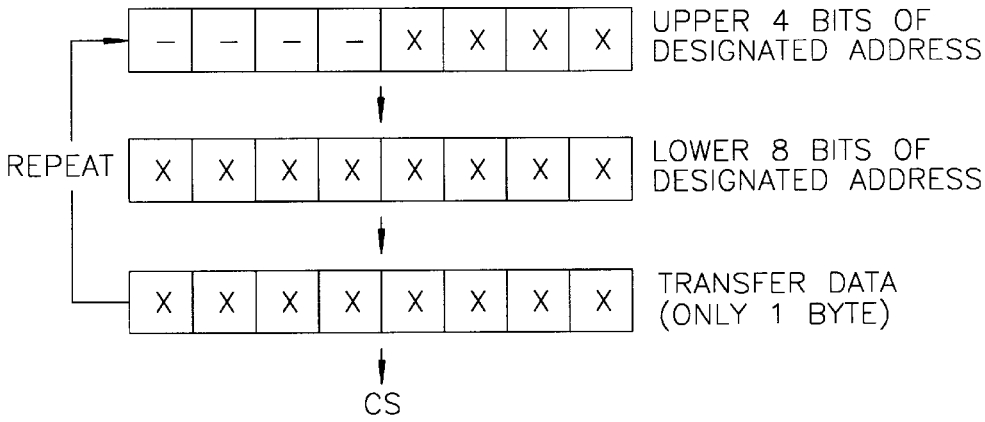

FIG. 7*d* shows command data used for setting a data transfer method in transferring the data to the display RAM 117. In this event, the upper four bits are set to be "0011" and the lower two bits, denoted by $D_1$ and $D_0$, are used for setting the data transfer method.

Setting of the lower two bits $D_1$ and $D_0$ to "11" indicates that the address of the display RAM 117 is increased by one bit in the horizontal direction of the memory map of FIG. 5 upon the completion of a writing of the data in an address in the display RAM 117 and next data is stored in the increased address and so on. In this way, the data is sequentially stored.

Setting of the lower two bits $D_1$ and $D_0$ to "10" indicates that the address of the display RAM 117 is increased by sixty four bits in the vertical direction in the memory map of FIG. 5 upon the completion of a writing of the data in an address in the display RAM 117 and next data is stored in the increased address and so on.

When the lower two bits $D_1$ and $D_0$ are set to be "01", the data are stored in a designated address. This mode is useful for displaying only on certain parts of the VFD 101.

In an increase mode, i.e., when the lower two bits $D_1$ and $D_0$ are set to be "11" or "10", the timing address is transferred by using the upper four bits followed by the next eight bits as shown in FIG. 7*e*1. Subsequently, every one byte of desired number of display data are transferred. Eventually, the introduction of the rising edge of the chip select signal completes this mode.

Similarly, in an address designation mode, i.e., when the lower two bits $D_1$ and $D_0$ are set to be "01", the timing address is transferred by using the upper four bits followed by the next eight bits as shown in FIG. 7*e*2. Subsequently, one byte of display data is transferred. If a new address is designated, the upper four bits followed by the next eight bits of the newly designated address are transferred. Subsequently, one byte of display data is transferred. These operations are repeated as another address is designated. Eventually, the introduction of the rising edge of the chip select signal completes this mode.

FIG. 8*f* shows the command data used in turning on the VFD 101. The upper four bits of the command data are set to be "0100". Upon receiving the command data, the controller drivers 100-1~n enter into a synchronized operation mode if more than one controller driver 100-1~n are employed. Another command data may follow this command. For instance, the display contents and the driving type may be altered by further setting the dimming or newly setting a timing address with this subsequent command data.

FIG. 8*g* shows a command data associated with a self-diagnosis function. The self-diagnosis function is related to checking the controller drivers 100-1~n and displaying the results of the check by way of graphic images or characters. This self-diagnosis function is optional. The upper four bits of this command data are set to be "0101".

FIG. 8*h* shows a command data used for setting a low power mode. Any grid without the anode data is forced to be in an "off" state in this mode with a view of reducing the power consumption. The upper four bits of the command data are set to be "0110", which indicates the low power mode. If the least significant bit $G_0$ is set to be "1", the low power mode is activated depending on the assignment of a grid data area and an anode data area within the memory map of the display RAM 117. When there exists a single, undivided memory area in which the anode data is stored in the display RAM as shown in FIG. 5, each port address corresponding to this area is transferred as a start address in transferring data, and, subsequently, an end address is transferred. The controller 120 determines whether there is anode data to be displayed every time the timing address is changed within the range of the port addresses corresponding to the single undivided memory area. If there is no anode data, i.e., all the anode data presents a low level, the controller 120 forces the grid driver 124 to turn off in order to make current flowing into the grids and anodes down to zero.

If, however, the least significant bit $G_0$ is set to be "0", the low power mode is no longer effective.

It is optional to employ the command data for the low power mode, but, instead, command data for use in coordination with an additional power supply, command data for use in setting a colored display or for use in setting a user-defined display designated by inputs from the keypad 103 may be adopted. In any of these events, however, regardless of the number of controller drivers 100-1~n employed, the host micom 102 is designed to control the whole operation of the display device shown in FIG. 1. It is also necessary, where more than one controller drivers are employed, to program for the controller drivers 100-1~n to operate in synchronism with each other.

Although the VFD 101 has been described has a display unit in the preferred embodiment, the present invention is applicable to any display unit equipped with anodes and grids that are constructed in a matrix form.

Figure 9:
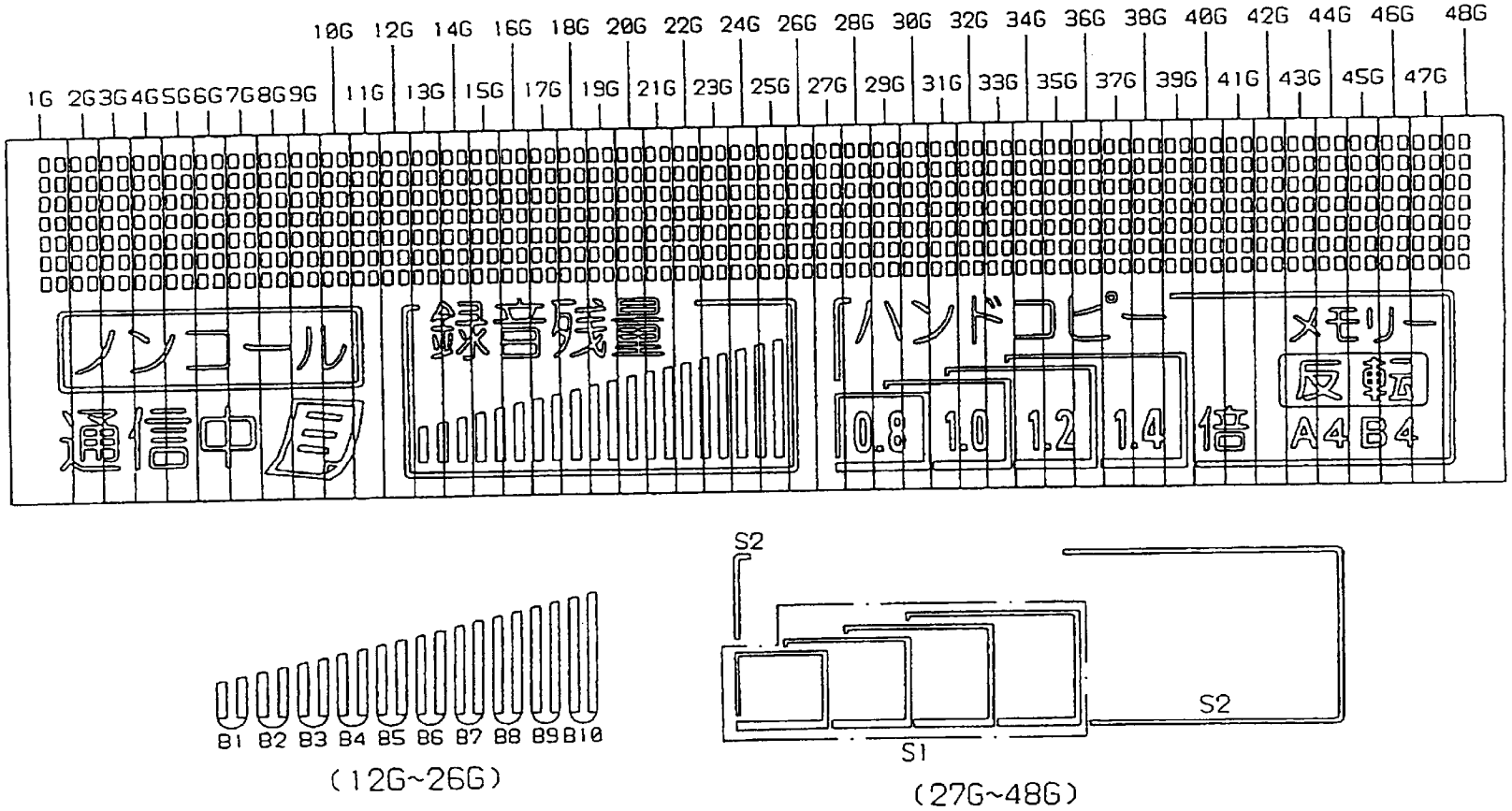
FIG. 9 shows an exemplary make-up of a display unit in accordance with the present invention.

FIG. 9 illustrates an exemplary make-up of the VFD 101 driven by the controller drivers 100-1~n.

The exemplary make-up includes a dot matrix area and a segment area, respectively. The dot matrix area is capable of displaying random shape characters or patterns and the segment area can only display predetermined patterns.

Figure 10:
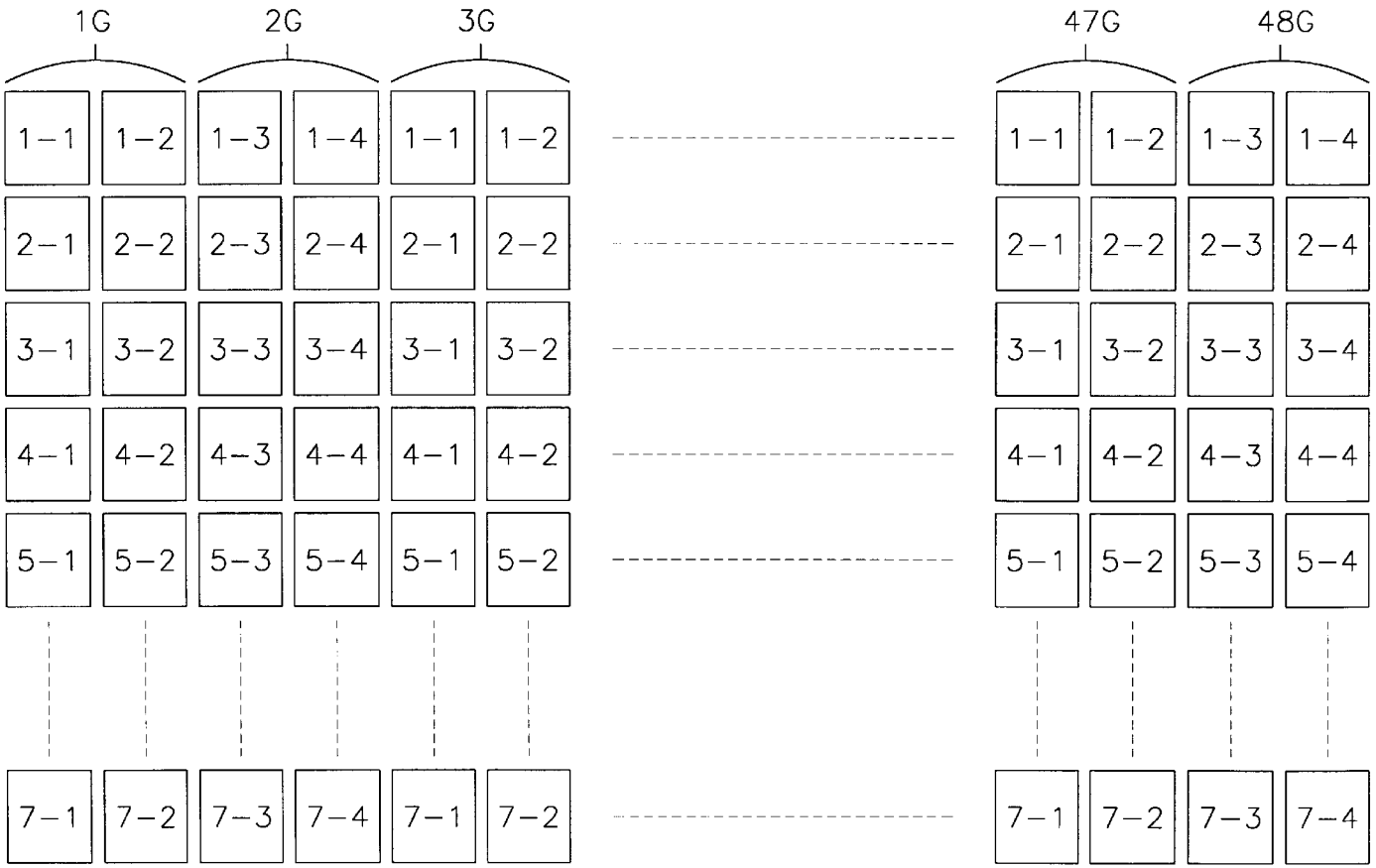
FIG. 10 provides exemplary connections of grid electrodes in accordance with the present invention.
Figure 12:
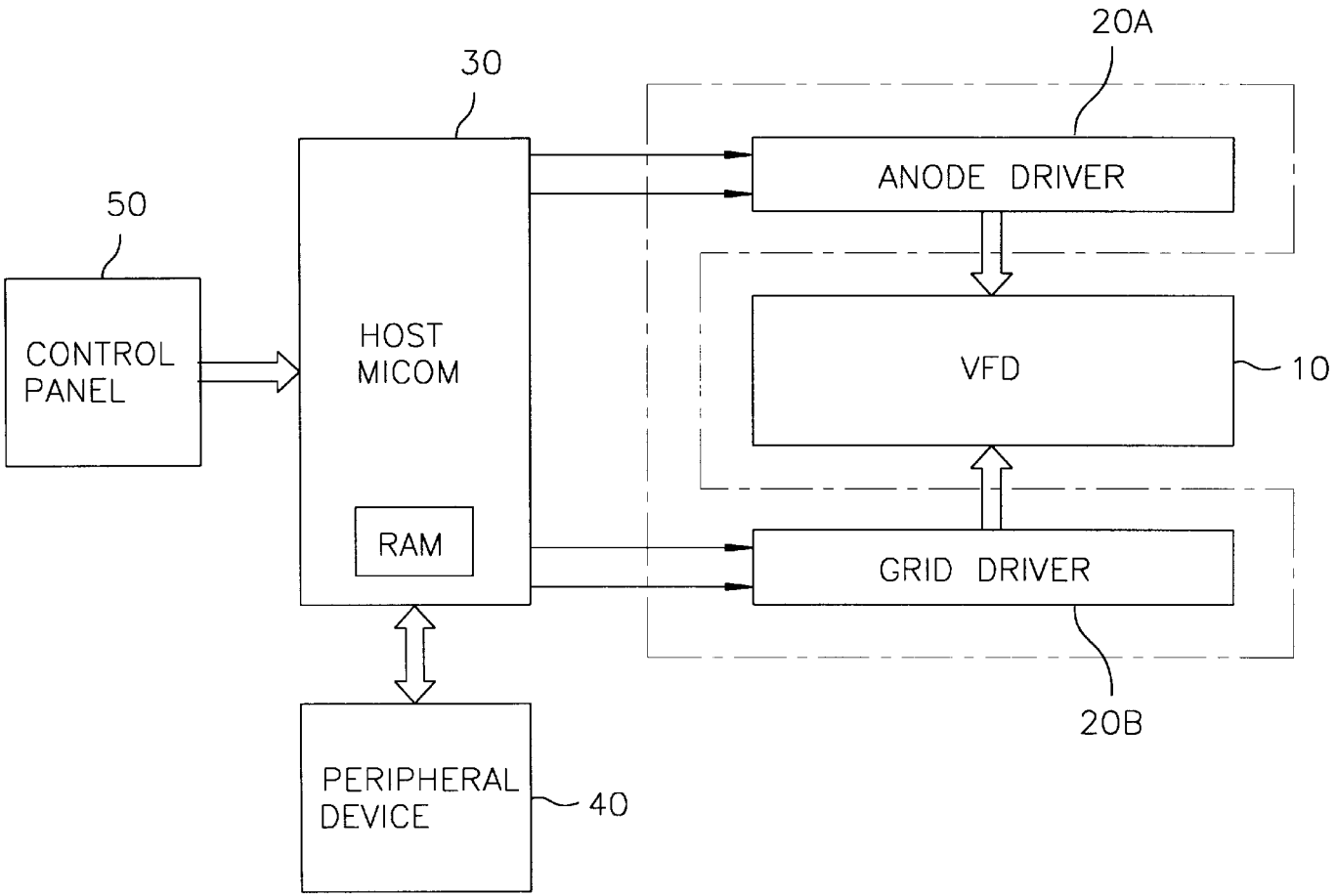
FIG. 12 (PRIOR ART)
FIG. 12 exhibits a block diagram of a conventional display device.
Figure 13:
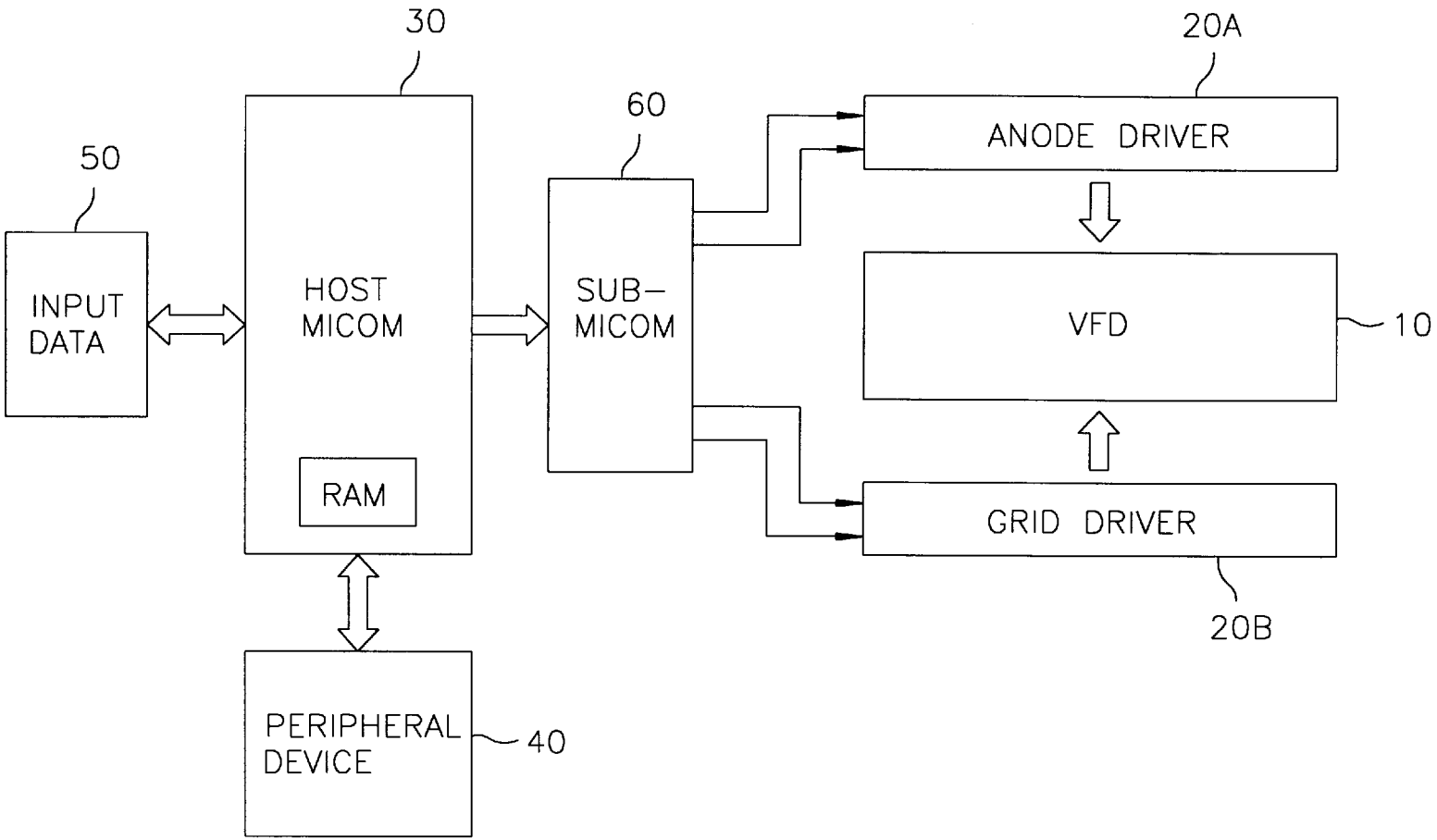
FIG. 13 (PRIOR ART)
FIG. 13 offers a block diagram of a modified conventional display device.

As shown in FIG. 10. There are included horizontally arranged 48 grids, each grid having a pair of concurrently driven grid wires. This pair of grids enables a so-called dual grid scan.

Referring to FIG. 11, the anodes are organized with 28 quartet matrices denoted by $P_1$ to $P_{28}$ as shown in FIG. 11 for the dot matrix area and with 12 anodes, $P_{29}$ to $P_{40}$ for the segment area.

In the preferred embodiment in accordance with the present invention, two scan patterns may be implemented: a dot display pattern in which each two grids is sequentially scanned with a half-cycle difference; and a segment display pattern in which three blocks of grids, e.g., grids 1G~11G, 12G~26G and 27G~48G as shown in FIG. 9, are sequentially scanned.

In accordance with the controller drivers 100-1~n in accordance with the present invention, since the anode data for display and the grid data for indicating the anode data are stored in the port address direction, i.e., the vertical direction in FIG. 5, retrieving the grid data and the anode data by using the timing address enables the display device to implement any driving mode.

Furthermore, where rather a large number of rows are involved for displaying, additional controller drivers as required can be employed without difficulty. This is because, in accordance with the present invention, the display data is independently transmitted and these are synchronously operated. Even in this case, since controller drivers added are identical, various settings thereof can be commonly made. This feature of the present invention makes it possible to implement more universal display device.

As described above, a plurality of controller drivers 100-1~n are synchronously operated and the anode data and the grid data coexist in the display RAM 117. Therefore, it is possible to adapt the controller drivers to a driving mode according to the display contents and to selectively use one or more controller drivers according to the size of the VFD 101 and the driving mode. Accordingly, a display device with higher universality can be readily implemented.

In addition, a further advantage of the display device in accordance with the present invention is that the lower power mode can be implemented by checking the anode data in the display RAM 117 as described above. This advantage becomes increasingly noticeable as the size of the display unit increases.

While the present invention has been described with respect to the preferred embodiments, other modifications and variations may be made without departing from the scope and spirit of the present invention as set forth in the following claims.

What is claimed is:

1. A controller driver for use in a display device comprising:

an interface for transferring data from/to a host computer;

a decoder for decoding the data received from the interface into command data and display data;

a display RAM for storing the display data received from the decoder, the display data including anode data and grid data;

an anode driver and a grid driver for driving a display unit based on the display data of the display RAM;

a controller for setting a display mode based on the command data and for retrieving the display data corresponding to a display mode; and a clock generator for providing timing signals for the interface, the decoder, the anode driver, the grid driver, the display RAM and the controller to coordinate the operation timing thereof, wherein the anode data and the grid data are provided to the anode driver and the grid driver, respectively, in synchronism with a predetermined timing address, the anode data corresponding to contents to be displayed and the grid data corresponding to a driving mode of the display unit.

2. The controller driver of claim 1, wherein the clock generator generates the timing signals so that the controller driver operates in synchronism with one or more additional controller drivers.

3. The controller driver of claim 1, wherein the display RAM is constructed so that the anode data for use in operating anodes and the grid data for use in operating grids are concurrently retrieved therefrom by means of the same timing address.

4. The controller driver of claim 3, wherein it is checked whether there is the anode data in every time slot while the anode data stored in the display RAM are retrieved therefrom, and a grid scan is halted during the timing slot when there is no anode data.

5. A method for driving a display device equipped with a plurality of controller drivers and a display unit, each of the controller drivers including: an interface for transferring data from/to a host computer; a decoder for decoding the data received from the interface into command data and display data; a display RAM for storing the display data received from the decoder; an anode and a grid drivers for driving a display unit based on the display data of the display RAM; a controller for setting a display mode based on the command data and for retrieving the display data corresponding to a display mode; and a clock generator for providing timing signals for the interface, the decoder, the display RAM and the controller to coordinate operation timing thereof, wherein the method comprising:

connecting the plurality of controller drivers to the display unit, distributing data corresponding to display areas of the display unit and controlling operations of the plurality of controller drivers in synchronism with each other as of turning on/off the display unit.

6. The method for driving a display device of claim 5, wherein the synchronism is achieved by providing a common synchronous signal to the clock generator in each controller driver.

7. The method for driving a display device of claim 6, wherein the grid data for use in operating the grids and the anode data for use in operating the anodes are stored common in a timing address.

8. The method for driving a display device of claim 7, wherein the scan data are set to be null during a non-display interval when there is no display data to thereby setting the display device in a low power consumption mode.

9. A controller driver, connected to a host micom for controlling operations of a display system and to a display unit, for actuating a display unit, the controller driver comprising:

an interface for transferring data from/to the host micom;

a decoder for identifying and dividing the data received from the interface into command data and display data;

a display RAM for storing the display data received from the decoder, wherein the display data includes anode data and grid data, the anode data being associated with display contents and the grid data being associated with a driving mode of the display unit;

an electrode driver, including therein an anode driver and a grid driver, for actuating the display unit by using the command data and the display data;

a controller for setting the driving type and a display mode by using the command data, and, for retrieving the display data and providing the display data to the electrode driver; and a clock generator for providing timing signals for the interface, the decoder, the anode driver, the grid driver, the display RAM and the controller to coordinate operation timings thereof, wherein the anode data and the grid data are provided to the anode driver and the grid driver, respectively, according to a predetermined timing address.

10. The controller driver of claim 9, wherein the display unit includes two kinds of electrodes, grids and anodes, respectively.

11. The controller driver of claim 10, further comprising a command data storage for storing the command data.

12. The controller driver of claim 11, further comprising an anode data latch for shifting the anode data and transferring the anode data to the anode driver, and, a grid data latch for temporarily storing the grid data and transferring the grid data to the grid driver.

13. The controller driver of claim 12, further comprising an input counter for designating addresses of the display data to be stored in a display RAM, and, an output counter for designating addresses of the display data being read out from the display RAM.

14. The controller driver of claim 13, wherein the memory area of the display RAM is divided into two parts, one for storing the anode data and the other for storing the grid data.

15. The controller driver of claim 14, wherein an assignment of each part is determined so that the anode data and the grid data are concurrently retrieved from the display RAM by means of the same timing address.

16. The controller driver of claim 15, wherein the clock generator generates the timing signals so that the controller driver operates in synchronism with one or more additional controller drivers.

17. The controller driver of claim 16, wherein it is checked whether there exists the anode data in every time slot while the anode data stored in the display RAM are to be retrieved therefrom, and a grid scan is stopped during the timing slot when there is no anode data.

* * * * *